US005486248A

United States Patent [19]

Taylor et al.

[11] Patent Number: 5,486,248

[45] Date of Patent: Jan. 23, 1996

[54] EXTRUDABLE GAS GENERANT FOR HYBRID AIR BAG INFLATION SYSTEM

[75] Inventors: Robert D. Taylor, Hyrum; Marc R. Andros, North Ogden, both of Utah

[73] Assignee: Morton International, Inc., Chicago, Ill.

[21] Appl. No.: 251,559

[22] Filed: May 31, 1994

[51] Int. Cl.[6] ..... D03D 23/00; D03D 43/00

[52] U.S. Cl. ..... 149/109.6; 264/3.3

[58] Field of Search ..... 149/109.6; 264/3.3

[56] References Cited

U.S. PATENT DOCUMENTS

| | | | |
|---|---|---|---|
| 3,692,495 | 9/1972 | Schneiter et al. | 23/281 |
| 3,723,205 | 3/1973 | Scheffee | 149/19 |
| 3,756,621 | 9/1973 | Lewis et al. | 280/150 |
| 3,785,149 | 1/1974 | Timmerman | 60/205 |
| 3,806,461 | 4/1974 | Hendrickson et al. | 252/188.3 |
| 3,862,866 | 1/1975 | Timmerman et al. | 149/21 |
| 3,897,285 | 7/1975 | Hamilton et al. | 149/41 |
| 3,901,747 | 8/1975 | Garner | 149/42 |
| 3,912,562 | 10/1975 | Garner | 149/41 |
| 3,919,012 | 11/1975 | McBride et al. . | |
| 3,939,018 | 2/1976 | Sayles | 149/19.1 |
| 3,950,009 | 4/1976 | Hamilton | 250/150 |
| 3,964,255 | 6/1976 | Cantanzarite | 60/205 |
| 4,115,167 | 9/1978 | Sbrocca | 149/19.5 |
| 4,238,253 | 12/1980 | Garner | 149/19.6 |
| 4,298,412 | 11/1981 | Biddle et al. | 149/19.5 |
| 4,407,119 | 10/1983 | Biddle et al. | 60/219 |
| 4,981,534 | 1/1991 | Scheffe | 149/19.91 |
| 5,062,365 | 11/1991 | Canterberry | 102/322 |
| 5,290,060 | 3/1994 | Smith | 280/737 |

OTHER PUBLICATIONS

Studies on Composite Extrudable Propellant with Varied Burning Rate Pressure Index "n"; Def. Sci. J, vol. 39, No. 1, Jan. 1989, pp. 1–12; T. L. Varghese et al.

*Primary Examiner*—Donald P. Walsh
*Assistant Examiner*—Anthony R. Chi
*Attorney, Agent, or Firm*—Robert M. Didrick; Gerald K. White

[57] ABSTRACT

The solvent-free gas generant composition of this invention, comprising an oxidizer and a thermosettable resin, cures in about an hour or less at room temperature and within 5 minutes at 135° F. Void-free and crack-free gas generant grains are formed and cured in an extrusion process in which the temperature may be from about room temperature to about 200° F. The thermosettable resin is at least one of the group consisting of an acrylate-terminated polybutadiene, a hydroxy-terminated polybutadiene/diisocyanate reaction product, an ester of a polybutadiene polycarboxylic acid and an epoxy modified polybutadiene and/or a hydroxyl-terminated polybutadiene, and a styrene/polyester copolymer.

8 Claims, 5 Drawing Sheets

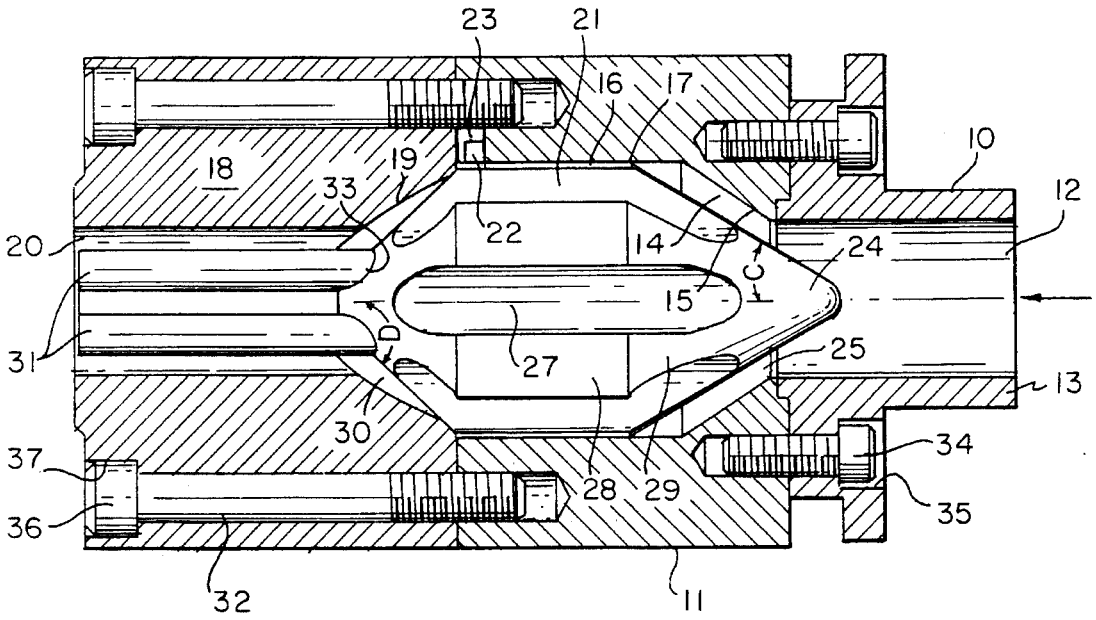
FIG. 2
FIG. 3
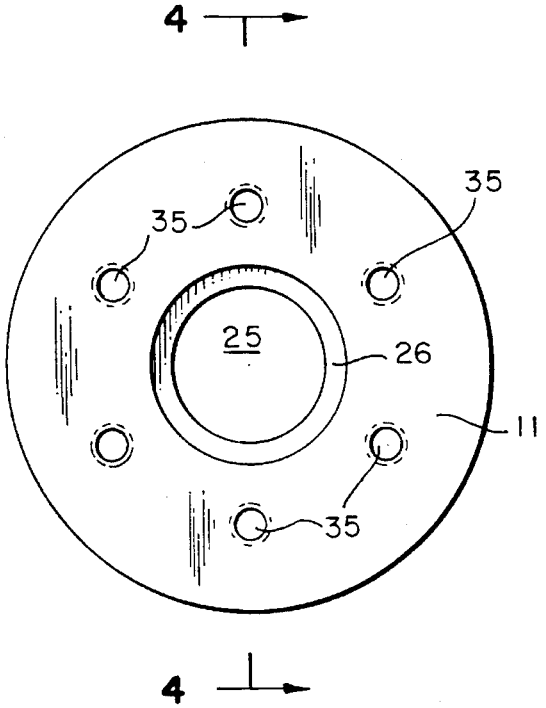
FIG. 4
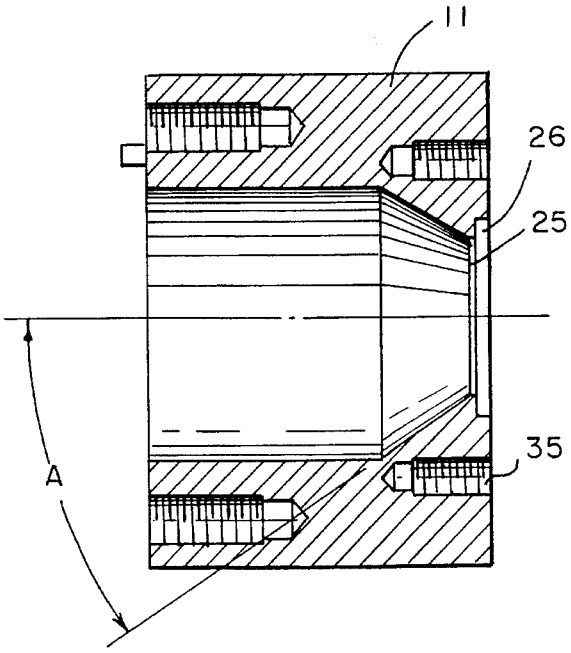

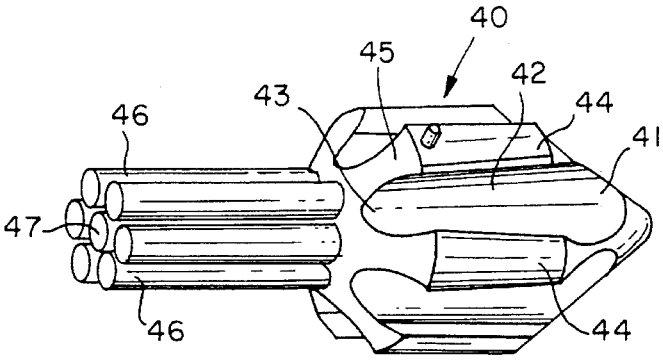
FIG. 8
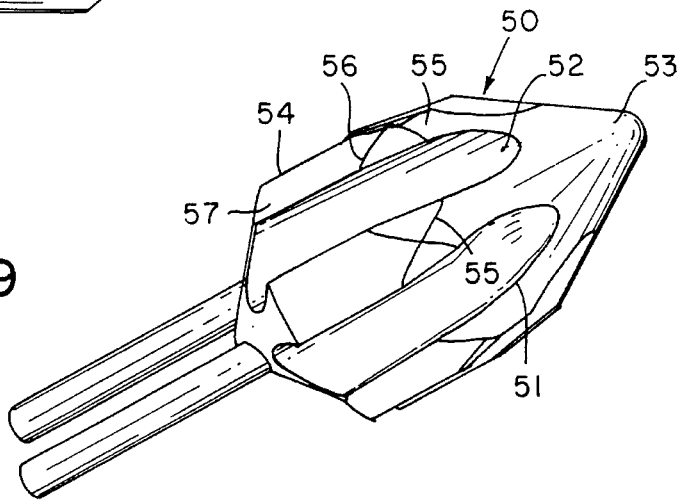
FIG. 9
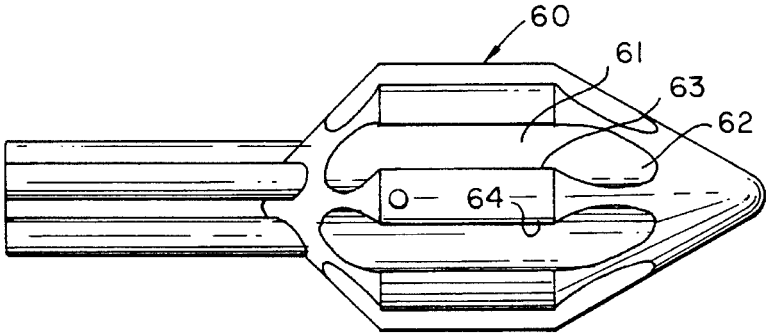
FIG. 10a
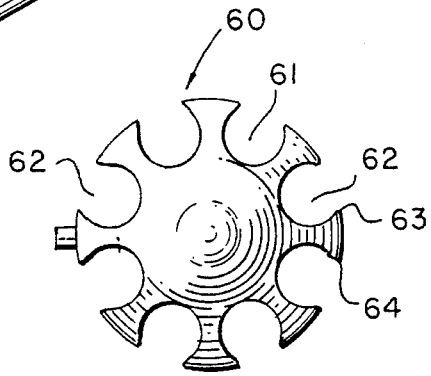
FIG. 10b
FIG. 11
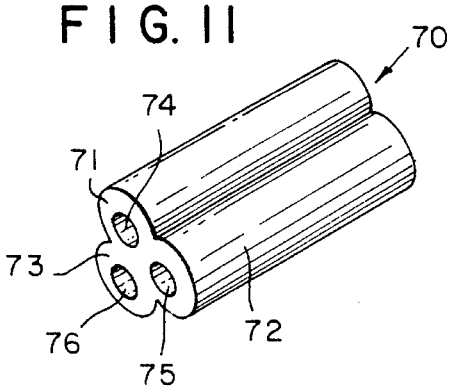

EXTRUDABLE GAS GENERANT FOR HYBRID AIR BAG INFLATION SYSTEM

BACKGROUND OF THE INVENTION

Field of the Invention

This invention relates to a hybrid gas generating system for the inflation of an inflatable restraint for passengers in a vehicle such as an automobile, a boat, or an airplane. More particularly, it relates to a novel, chlorine-free gas generant which utilizes an extrudable thermosetting binder whose combustion products are essentially free of nitrogen oxides.

As is well known in the inflatable restraint art, compressed gas may be utilized to inflate an air bag or similar safety cushion in a moving vehicle in the event of a sudden deceleration of the vehicle, such as that caused by a collision, for the protection of a passenger in the vehicle. Such compressed gas may be the only inflating material or its action may be augmented by the heat and gas generated by the combustion of a fuel in a heater cartridge which is adapted to communicate with a chamber containing said compressed gas. Similarly, various pyrotechnic compositions have been proposed for generating a gas upon combustion in order to serve as the sole inflating agent of an air bag or to augment a compressed gas. Exemplary of the many patents issued in this field are U.S. Pat. Nos. 3,692,495 (Schneiter et al); 3,723,205 (Scheffee); 3,756,621 (Lewis et al); 3,785,149 (Timmerman); 3,897,285 (Hamilton et al); 3,901,747 (Garner); 3,912,562 (Garner); 3,950,009 (Hamilton); 3,964,255 (Catanzarite); 4,128,996 (Garner et al); 4,981,534 (Scheffee); and 5,290,060 (Smith), which is incorporated herein by reference.

The use of compressed gas as the sole inflating agent is subject to a variety of disadvantages such as bulkiness of the container which makes it difficult to store in places such as the steering wheel or dashboard of a car. Also, the pressure in the container may rise to undesirable levels along with the ambient temperature. Moreover, the response time of a system using compressed solely is unacceptably slow. On the other hand, several criteria must be met by a pyrotechnic gas generant to be satisfactory for inflatable restraint systems. It must produce non-toxic, non-flammable and smokeless gas over a wide range of temperatures and other environmental conditions. The temperature of the generated gases must be sufficiently low that they may be cooled further by the conventional coolant techniques known in the art so as not to destroy the air bag or injure the passenger. The pyrotechnic must be safe to handle and must be capable of generating a very large amount of gas within a very short time frame, i.e., about 35 milliseconds.

Sodium azide-based compositions are the current leaders in all-pyrotechnic inflation systems both driver side and passenger side installations because of their excellent gas generating properties and the non-toxic nature of the nitrogen gas produced. Passenger side installations require much larger volumes of gas, however, and hybrid systems are being turned to in order to satisfy that requirement. The two Scheffee patents mentioned above teach the use of a PVC plastisol [poly (vinyl chloride) plus a plasticizer] as a fuel and binder for the pyrotechnic material in a hybrid gas generator. The presence of the poly (vinyl chloride) requires a PVC stabilizer. It also requires a chlorine scavenger to prevent the passage of toxic chlorine or hydrogen chloride gas into the air bag and thence into the passenger compartment. Thus, in addition to the binder, plasticizer, stabilizer, and oxidizer, the pyrotechnic material must contain an alkali- or alkaline earth metal salt and may contain carbon, iron oxide, and a transition metal oxide. This makes a complex system.

To replace sodium azide, Garner et al teaches polyacetal and poly (vinyl acetate) resins as fuel for the gas generating combustion in an air bag inflator. The resin and oxidizer are milled in a solvent, then dried and pressed into pellets. Lewis et al teaches the use of argon as the compressed gas and a poly vinyl composite or other material as the gas generating combustible material in a hybrid system. Schneiter et al teaches that a solid fuel for air bag inflators may be made by curing a mixture of a liquid carboxyl-terminated polyester, a diglycidyl ether of bisphenol A, potassium perchlorate, aluminum oxide, and a catalyst for 72 hours at 135° F.

In order for formulations containing thermosetting binders to be extrudable, several conditions must be satisfied. Among them are:

- The viscosity of the formulation must be high enough when it exits the extruder that the extrudate will hold its shape until curing is complete. This means that the mix viscosity must be high enough that curing reactions in the extruder are unnecessary; or
- If the uncured composition does not have that requisite viscosity, the cure chemistry of the formulation must allow at least partial curing within the extruder to control the exudate viscosity so that it may be formed into a grain with controlled dimensions and which will retain them while full cure is progressing; and
- Rapid curing reactions within the extruder are undesirable; rapid curing and the consequent plugging and overheating must be avoided.

In an article entitled "Studies on Composite Extrudable Propellant with Varied Burning Rate Pressure Index 'n'", *Def. Sci. J.*, Vol. 39, No.1, January 1989, pp 1–12, T. L. Varghese et al teach that the evaporation of process solvents creates porosity, internal cracks, and dimensional variation during solvent extrusion of propellants. Citing the better physical and mechanical properties of extruded cross-linked composite propellants, along with better aging characteristics, dimensional stability, and better ballistics control, Varghese et al described a propellant comprising a carboxyl-terminated polybutadiene, ammonium perchlorate, and a diepoxy-triaziridine combination as the curing agent. The proper consistency for successful extrusion was achieved only after seasoning the thermosetting propellant mix at 60° C. (140° F.) for six hours.

SUMMARY OF THE INVENTION

It is an object of the invention, therefore, to provide a thermosettable gas generating composition which may be mixed at a low viscosity and cured at room temperature in about one hour or less, or at 135° F. in about fifteen minutes or less.

It is a related object of this invention to provide a thermosettable fuel+oxidizer composition which may be extruded safely promptly after mixing said fuel and oxidizer.

It is another related object of this invention to provide a thermosettable fuel+oxidizer composition which may be mixed and extruded into a predefined shape in a single extrusion.

It is another related object of this invention to provide a dense, non-porous gas generant grain which minimizes the risk of an explosion caused by combustion-induced fracture.

It is a related object of this invention to provide a hybrid gas generating system for air bag inflation in which an extruded fuel-oxidizer grain supplies heat for expansion of a compressed gas and does not require the presence of hydrohalide scavengers or sulfur-containing stabilizers.

It is another object of this invention to provide a gas generant for air bag inflation which produces little or no toxic gases such as sulfur dioxide, the nitrogen oxides and carbon monoxide.

It is a related object of this invention to provide a method for extruding thermosettable fuel+oxidizer composition safely promptly after mixing said fuel and oxidizer.

These and other objects of this invention which will become apparent from the following description and the accompanying drawings are achieved by a method comprising mixing an oxidizer, a curing agent, and at least one thermosetting resin selected from the group consisting of an acrylate terminated polybutadiene, a hydroxy-terminated polybutadiene/diisocyanate reaction product, an ester of a polybutadiene polycarboxylic acid and an epoxy modified polybutadiene and/or a hydroxyl-terminated polybutadiene, and a styrene/polyester copolymer, and pushing the mixture through an extruder in which a temperature of from about room temperature to about 200° F. is maintained. The mixing step may be performed separately from the extrusion step but it is preferable to perform the mixing, extruding, and partial curing steps in the extruder. In accordance with the preferred procedure, a gas generant composition having a relatively low initial viscosity is transformed into an extrudate capable of retaining the shape imparted to it as it exits the die attached to the extruder. Partial curing in the extruder is feasible because the auto-ignition temperature of the above listed binders is much higher than their curing temperatures. The short curing time is another factor which makes curing during extrusion feasible.

BRIEF DESCRIPTION OF THE DRAWINGS

In the detailed description which follows, reference is made to the accompanying drawings of a die assembly used in the extrusion process of this invention; like parts are designated by the same reference numbers in said drawings, of which:

FIG. 2 is a cross-section of the die assembly of FIG. 1;

FIG. 3 is an end view of the whole right face of the die body receiving chamber opposite the coupler shown in FIG. 1;

FIG. 4 is a cross section of the receiving chamber taken along the line 4—4 of FIG. 3;

FIG. 8 is a perspective view of another embodiment of the die insert of this invention;

FIG. 9 is a perspective view of another embodiment of the die insert of this invention;

FIG. 10*a* is an elevation of another embodiment of the die insert of this invention and FIG. 10*b* is an end view of said insert;

FIG. 11 is a perspective view of an extruded and cured gas generant grain made with the die insert of FIGS. 1 and 2.

DETAILED DESCRIPTION OF THE INVENTION

Figure 1:
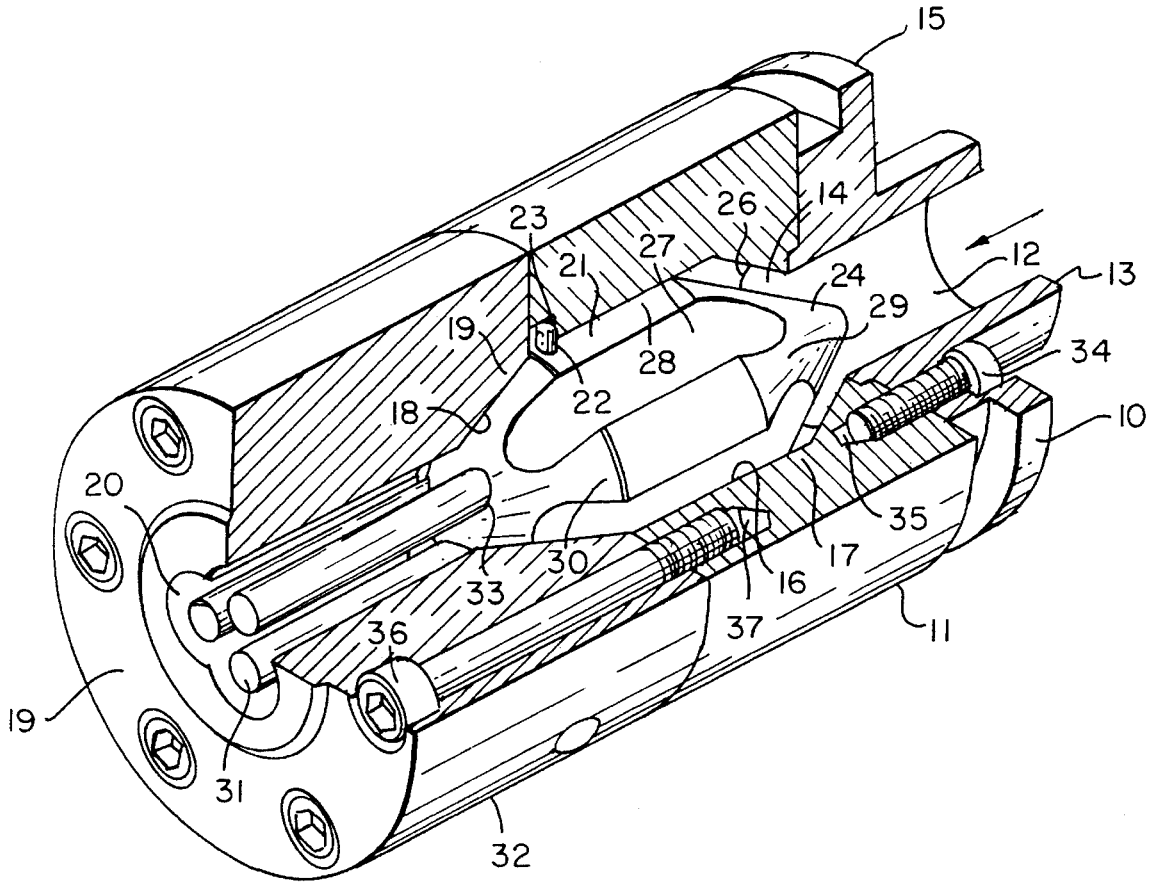
FIG. 1 is a partially broken away perspective view of a die assembly comprising the die body, die insert, and die/extruder coupler which are useful for the extrusion of gas generant grains of this invention.

The thermosetting resins which serve as a binder and as a fuel in this invention are preferably liquids at room temperature or slightly higher. Liquid resins make possible low viscosity mixing of oxidizers, plasticizers, coolants, slag modifiers, burning rate modifiers, and other additives with the binder-fuel. An example of the acrylate terminated polybutadiene is the product sold under the trademark Poly BD 300 by Elf Atochem North America, Inc. Its number average molecular weight is 3000, its specific gravity is 0.91, and its viscosity at 25° C. (77° F.) is 4500 mPa.s (4500 cps). It is cured with a peroxide such as methyl ethyl ketone peroxide. In the presence of a cure accelerator such as a metal salt of an organic acid, e.g., a manganese tallate available from Mooney Chemicals, Inc. under its Lin-All trademark, the Poly BD resin cures within one hour at room temperature and within five minutes at 135° F.

Liquid, hydroxyl-terminated polybutadiene resins having a number average molecular weight of from about 1200 about 3000 are suitable starting materials for conversion to the polyurethanes by the reaction with a diisocyanate or polyisocyanate according to this invention and also for conversion to the aforementioned esters by reaction with a polybutadiene polycarboxylic acid anhydride. The viscosity of the hydroxyl-terminated resin at 23° C. ranges from about 2600 to about 8000 mPa.s (2600 to 8000 cps). The hydroxyl functionality is from about 2.2 to about 2.6.

Isocyanates suitable for curing the hydroxyl-terminated polybutadiene resin are exemplified by isophorone diisocyanate, toluene diisocyanate, diphenylmethane 4,4'-diisocyanate (MDI), hexamethylene diisocyanate (HDI), and bis(4-isocyanatocyclohexyl) methane. Polyisocyanates based on the foregoing diisocyanates are also useful for curing the hydroxyl-terminated polybutadienes according to this invention. The weight ratio of the resin to diisocyanate in a mixture comprising a hydroxyl-terminated polybutadiene, isophorone diisocyanate is suitably about 12.5 to 1.

For the purposes of this invention, a polycarboxylic acid has two or more carboxylic acid groups. Thus, the polybutadiene polycarboxylic acid used as a starting material in the preparation of the aforementioned esters may have two or more carboxylic groups pendant from the polybutadiene chain such as in a maleic anhydride modified polybutadiene. Examples of such a polycarboxylic acid include a viscous liquid available under the trademark Ricotuff 1110 from Ricon Resins, Inc. and a poly(butadiene/acrylic acid) (C.A. Registry No. 25067-26-9). Such a copolymer is available from B. F. Goodrich under its Hycar trademark. Another example of the polycarboxylic acid useful in this invention is a polybutadiene dicarboxylic acid in which both acid groups are terminal; Butarez CTL resin sold by Phillips Petroleum having carboxyl contents of from about 1.1 to about 1.7% by weight and viscosities of about 260–280 poises are examples. Telechelic copolymers of butadiene and an acrylic acid made with a free radical catalyst also are terminated by the acid groups. Their viscosity is on the order of 10–40 Pa.s or 100–400 poises.

The epoxy modified polybutadiene resin is exemplified by the Poly bd 600 and 605 resins sold by Elf Atochem. The 600 resin has a viscosity of 5500 mPa.s (5500 cps) at 25° C. and an epoxy equivalent weight of 460. The 605 resin has a viscosity of 25000 mPa.s (25000 cps) at 25° C. and an epoxy equivalent weight of 260.

A binder for the gas generant composition of this invention which is made by reacting stoichiometric amounts of a maleic acid modified polybutadiene resin and an epoxy modified polybutadiene resin along with a cure accelerator remains liquid initially but it cures in about 1.5 hours at room temperature. At 135° F., the mixture cures within 5 minutes. Imidazole and alkyl-substituted imidazoles are suitable cure accelerators. About 0.04% by weight of an accelerator is satisfactory.

Short chain polyesters are suitable for admixture with styrene to give thermosettable binder compositions of this invention. Examples of such admixtures include those in the Laminac series available from Aristech Chemical Corporation as clear liquids which have viscosities ranging from 480 to 2250 cps (RVF #3 at 20 rpm and 25° C.). The styrene content is from about 30% to about 40% by weight and the acid number is from 17 to 27. A gas generant composition of this invention comprising such an admixture cures within an hour at room temperature and within about 10 minutes at 135° F.

The gas generant compositions of this invention are solvent-free so that the grains formed therefrom are dense and non-porous, free of voids and cracks to minimize the risk of an explosion caused by combustion-induced fracture along such voids and fractures. For the purposes of this invention, the term solvent means a volatile organic solvent which will evaporate from the grain at or below the temperature of curing. The plasticizers suitable for this invention do not come within that definition of a solvent and are exemplified by the alkyl and alkoxyalkyl adipates, sebacates, phthalates, and azelates. They are further exemplified by dioctyl adipate and dioctyl sebacate. From 0 to about 25% of the total weight of the gas generant composition may be a plasticizer.

The gas generant composition of this invention contains a sufficient amount of an oxidizer or combination of oxidizers to convert all of the available carbon to carbon dioxide and all of the available hydrogen to water. A sufficient amount will usually be in the range of from about 70% to about 90% by weight of the total composition. These are exemplified by alkali-, alkaline earth-, and transition metal perchlorates, chlorates, and nitrates. The alkali metals include sodium, potassium, and lithium. The suitable alkaline earth metals include calcium, strontium, and barium. Potassium chlorate and potassium perchlorate are specific examples of the oxidizers suitable for this invention. Ammonium perchlorates and ammonium nitrates are also useful. Transition metal oxides such as cupric oxide and manganese dioxide are further examples of oxidizers for this invention.

Slag modifiers such as alumina, silica, titanium dioxide, boric oxide, bentonite clay, and various metal oxides and nitrides make up from 0 to about 30% of the weight of the gas generant composition. Such modifiers may be fibrous or non-fibrous particulate matter.

The flame temperature achieved upon combustion of the gas generant of this invention is from 2800° to 3200° K. and it may be modified by use of a coolant. Examples of suitable coolants include the oxalates, carbonates, chlorides, and hydroxides of alkali- and alkaline earth metals such as sodium, potassium, lithium, calcium, and strontium. Magnesium carbonate, lithium carbonate, calcium carbonate, and strontium carbonate or other readily decomposable metal carbonate further exemplify the coolant. When used at all, the coolants are used at rather low levels in the gas generant composition, the maximum being about 30% by weight.

Catalysts and burn rate modifiers are also optional but when used in the gas generant of this invention, they constitute up to about 5% of the total weight. Examples of these additives include boron hydrides and transition metal oxides such as copper oxide, manganese oxide, and vanadium oxide.

The burn rate of a grain of the gas generant having a cross section of about 1 inch at 3000 psi is on the order of about 1.5 to 3 inches per second.

The amount of gas generant of this invention required for the operation of a hybrid gas generating system for the inflation of a conventional passenger side air bag is approximately 25 grams (about 1 ounce). In general, 100 grams of the gas generant will produce about 2 moles of gas.

The firing of a 300 mm hybrid inflator comprising 169 grams of argon and a gas generant grain of this invention weighing 20 grams into a 100 liter tank generated about 400–500 ppm of carbon monoxide, about 50 ppm of nitrogen oxides (about 90% nitric oxide), and about 4 ppm of sulfur dioxide.

Grains of the gas generant of this invention may be formed either by molding or by extrusion. In accordance with the aforementioned rates of curing of the gas generant, molding may be carried out at from room temperature (herein defined to be from about 68° to about 74° F.) to about 200° F. It is preferred, however, that the temperature be from about 100° to about 135° F. to allow sufficient but not excessive time for the flow of the liquid gas generant composition in and around the cavity and projections of the mold. At about 40° F., for example, the in-mold time may be about 45 minutes. The desired shaping of the gas generant grain may be more quickly assured in an extrusion process, however. The extrusion of the gas generant grain of this invention is preferably conducted at a temperature of from about 135° to about 150° F. so that the length of the extrusion tube may be minimized. Lower or higher extrusion temperatures (e.g., room temperature to about 200° F. or even higher) may be utilized as circumstances dictate so long as a safe margin below the ignition temperature of the mixture of fuel and oxidizer. An extruder such as the Haake Rheocord 90 sold by Fisons Instruments, Inc., or an equivalent thereof is suitable for small, pilot plant scale extrusions but large scale production of the gas generant of this invention is achieved with a twin-screw extruder such as is sold by APV Chemical Machinery, Inc. For the shaping of a generally cylindrical, perforated gas generant grain of this invention, the attachment to the extruder of a die and die insert such as shown in the drawings is preferred. A die insert capable of forming one or more longitudinal bores or perforations in the grain is particularly preferred.

With further reference to the drawings, the direction of flow of the gas generant from an extruder (not shown) through the die coupler 10 into the generally toroidal die body 11 in FIGS. 1 and 2 is shown by the arrow. The throat 12 formed by the annular wall 13 of the coupler communicates with the receiving chamber 14 having the shape of a truncated cone and formed by the outwardly sloping wall 15 (with respect to the axis of the die assembly) and thence with the cylindrical chamber 16 formed by the wall 17 and the forcing cone 18 formed by the lobate, inwardly sloping, annular wall 19. The lobate shape of the wall 19 is formed by the longitudinal channels 20 (see FIGS. 5 and 6) arrayed juxtaposedly in said wall 19. The slope of the wall 15 which defines the chamber 14, indicated by angle A in FIG. 4, is 33°, as shown, but it may be from about 10° to about 45° with respect to the die assembly axis. The slope of the wall 19 which defines the converging forcing cone 18, indicated by angle B is 30°, as shown, but it also may be from about 10° to about 45° with respect to said axis.

The die insert 21 is aligned with the die body 11 by one or more alignment pins 22 which project outwardly from the insert into one or more slots 23 in the die body. The leadin 24 of the insert is tapered at an angle C to the axis of 30° and projects through the port 25 defined by the annular terminus 26 of the wall 15 into the throat 12 for about one fourth of the length of the throat, thus enhancing the flow of gas generant composition into the die while reducing the pressure on the die. Although the angle C is preferably about 30°, as shown, it may be from about 10° to about 45°. The longitudinal flutes 27 are spaced apart equidistantly in and around the surface 28 of the insert 21 to receive the gas generant composition flowing from the extruder and force it into the convergent forcing cone 18 of the die body 11. With reference to the extruder, the flutes 27 extend from less than halfway along the tapered proximate portion 29 of the surface 28 into the tapered distal portion 30 of the surface 28. The angle D at which the distal portion 30 slopes is preferably 46°, as shown, but it may be from about 40° to about 50°. The flutes 27 are spaced apart in operative relation to the elongate pins 31 so that the constricted flow of the gas generant composition is forced into the forming chamber 32 at and between each of the pins 31 which project in the downstream direction from the distal portion 30 of the insert. Said pins are press fit into the bores 33 in the sloped distal surface 30. Said tapered distal surface 30 eliminates turbulence in the flow of the gas generant composition and thereby the formation of dead spots in the forming chamber 32.

The bolts 34 pass through the bolt holes 35 to secure the coupler 10 to the die body 11. The bolts 36 pass through the bolt holes 37 to fasten the die body 11 to the forming chamber 32.

Figure 5:
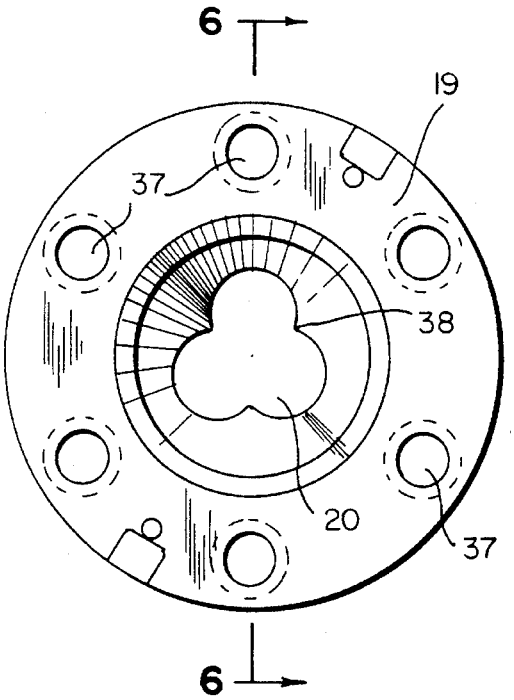
FIG. 5 is an end view of the whole left face of the die body forcing chamber opposite the receiving chamber of FIG. 3.
Figure 6:
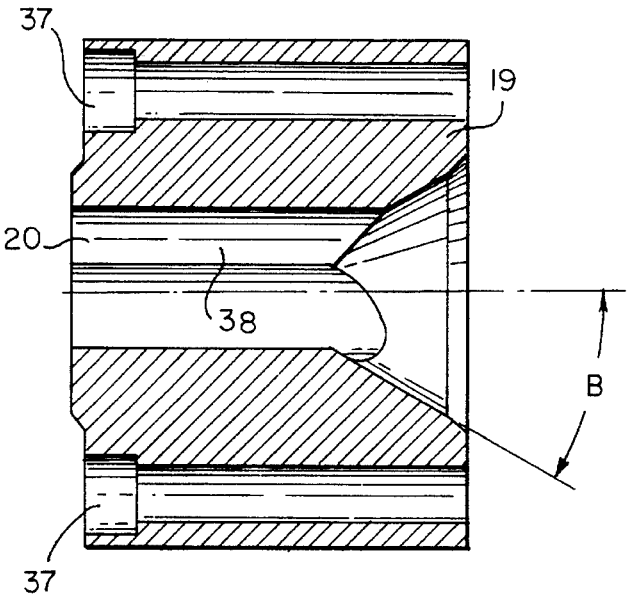
FIG. 6 is a cross section of the forcing chamber taken along the line 6—6 of FIG. 5.

The relative positions of the port 25 and the annular terminus 26 of the wall 15 of the receiving chamber 14 are shown in FIG. 3 along with the annular array of the bolt holes 35 and the alignment pin 22. As mentioned above, the angle A in FIG. 4 may be from about 10° to about 45° with respect to the axis of the die assembly—indicated here by the dashed line. In FIG. 5, the annular array of bolt holes 37 and the lobate channels 20 are shown in the annular wall 19. In FIG. 6, the juncture 38 between two channels 20 is shown along with the angle B which shows the slope of the wall 19 with respect to the axis of the die assembly.

Figure 7:
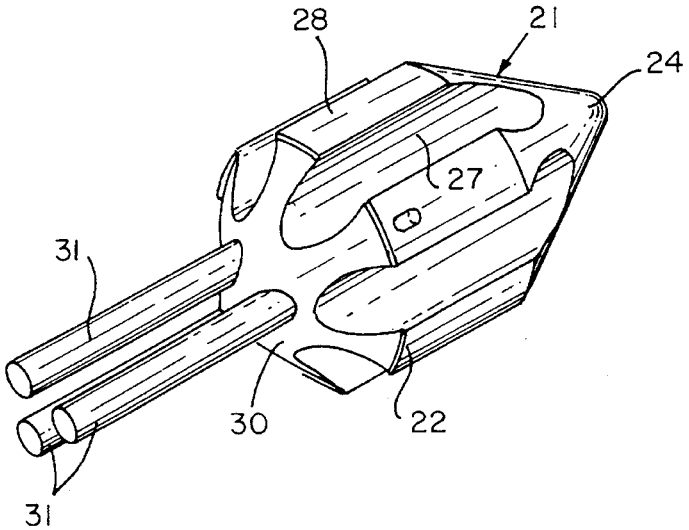
FIG. 7 is a perspective view of the die insert of FIG. 1.

In FIG. 7, the longitudinal flutes 27 are shown to extend from the tapered leadin 24 of the die insert 21 to the tapered distal portion 30 of the surface 28 and the elongate pins 31 are shown to project from that tapered distal surface 30. The alignment pin 22 projects from the surface 28.

The die insert 40 shown in FIG. 8 is also suitable for use in this invention. The mouth 41 at the proximate end of the flute 42 is wider than the distal portion 43 so that a greater initial flow area is provided for the gas generant composition while the die insert size remains the same. The edges 44 of the flute 42 approach one another as they enter the distal surface 45 of the die insert 40. Six elongate hole-forming pins 46 project from the distal surface 45 of this embodiment of the die insert and are equidistantly spaced apart from each other and from the elongate hole-forming center pin 47.

The die insert 50 shown in FIG. 9 reduces the drag on the flow of the gas generant composition into the forming chamber of the die body used. Said reduction is achieved by the chamfers 51 sloping toward the flutes 52 at the shoulder between the leadin 53 and the generally cylindrical member 54 of the die insert. The chamfers 51 lower the barriers set up by the die metal along the edges 55 and 56 between the flutes and leadin 53 and the cylindrical wall segments 57, respectively.

In the die insert 60 of FIG. 10*a*, the flutes 61 are expanded at their mouths 62 but the edges 63 and 64 of the flutes are not tapered as in FIG. 8 because the mouths have a shape somewhat like a horseshoe as shown in FIG. 10*b*.

The perforated grain 70 in FIG. 11 is an indefinitely long integral body made up of the three interconnected, generally cylindrical lobes 71, 72, and 73 through which the perforations 74, 75, and 76 extend lengthwise.

Several embodiments of the invention are described in more detail in the following examples. The compositions are described in terms of percent by weight of each component unless otherwise stated. Care must be taken that easily oxidizable components such as manganese tallate are not mixed directly with a peroxide. Two or more of the other components may be mixed before the peroxide is added.

EXAMPLE 1

A paste-like gas generant composition, made by mixing the following components in a Hobart mixer at room temperature, was formed into grains containing seven elongate perforations by placing the mixture in a mold and heating it at 40° C. (104° F.) for 45 minutes.

| | |
|---|---|
| Acrylate-terminated polybutadiene (Atochem Poly Bd 300) | 8.41% |
| Methylethyl ketone peroxide | 0.127% |
| Mn Tallate (Mn Lin-All by Mooney) | 0.043% |
| Dioctyl sebacate | 4.29% |
| Potassium perchlorate | 87.13% |

EXAMPLE 2

The mixture of Example 1 was formed into cylindrical grains having seven elongate perforations in a Haake Rheocord 90 extruder using a die insert similar to that of FIG. 8. Heat was applied to the die assembly only and only in an amount sufficient to raise its temperature to 65° C. (149° F.).

EXAMPLE 3

A grain of gas generant similar to that of Example 2 was fired off in a hybrid gas generator in which argon was the inert stored gas. The composition burned rapidly and did not generate toxic levels of carbon monoxide.

EXAMPLE 4

Another paste-like gas generant composition, made by mixing the following components in a Hobart mixer at room temperature, was found to cure within about 1.5 hours at room temperature and within about 5 minutes at 135° F.

| | |
|---|---|
| Maleic anhydride modified polybutadiene (Ricotuff 1110, Part A) (contains imidazole curing agent)† | 5% |
| Epoxy modified polybutadiene (Atochem Poly Bd 605) | 5% |
| Dioctyl sebacate | 5% |
| Potassium perchlorate | 85% |

†equivalent to 0.04% of total composition weight

EXAMPLE 5

Another gas generant composition, made by mixing the following components in a Hobart mixer at room temperature, cured in about one hour at room temperature and within about 10 minutes at 135° F.

| | |
|---|---|
| Polyester/styrene (61:39)$_{wt}$ (Laminac 4110) | 19.0 |
| Methyl ethyl ketone peroxide | .30 |
| Potassium perchlorate | 80.7 |

EXAMPLE 6

A paste-like gas generant composition, made by mixing the following components in a Hobart mixer at room temperature, cured in less than an hour at room temperature and in less than five minutes at 135° F.

| | |
|---|---|
| Hydroxy terminated polybutadiene (Poly bd R-45HT) | 11.71 |
| Isophorone diisocyanate | 0.94 |
| Metal-containing cure accelerator | 0.02 |
| Potassium perchlorate | 87.33 |

EXAMPLE 7

A paste-like gas generant composition, made by mixing the following components in a Hobart mixer at room temperature, cured in less than an hour at room temperature and in less than five minutes at 135° F.

| | |
|---|---|
| Maleic anhydride modified polybutadiene ((Ricotuff 1110, Part A; contains imidazole)† | 2.5% |
| Epoxy modified polybutadiene (Atochem Poly Bd 605) | 7.6% |
| Dioctyl sebacate | 2.5% |
| Potassium perchlorate* | 87.4 |

†equivalent to about 0.02% of total weight of composition
*Weight ratio of 100 μ/10 μ particles = 70/30

EXAMPLE 8

Figure 12:
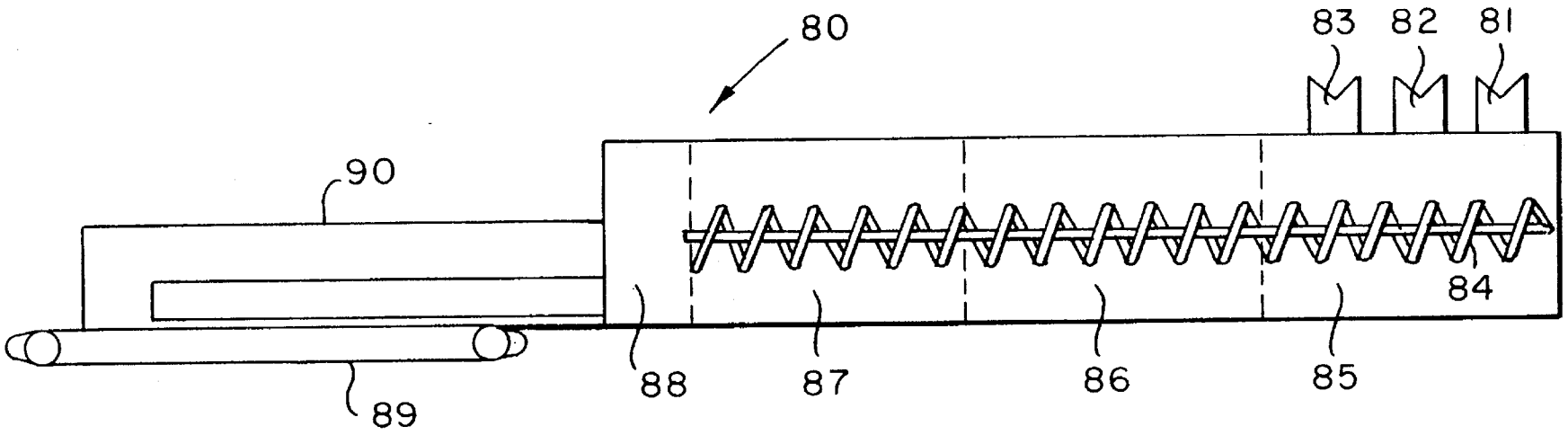
FIG. 12 is a schematic drawing of an extruder used to make the gas generant grain of this invention.

With reference to FIG. 12 of the drawings, a bimodal potassium perchlorate comprising a 70/30$_{wt}$ mixture of 100 μ and 10 μ particles and a small, effective amount of flow aid was introduced into an extruder 80 (such as an APV twin screw extruder) through the port 81 simultaneously with the separate introductions into said extruder of two liquid components of a gas generant composition of this invention through the ports 82 and 83 as the twin screws 84 were turning. The first liquid component consisted of 99.6% by weight of Atochem Poly Bd 300 acrylate-terminated polybutadiene and 0.4% by weight of manganese tallate; the second liquid component consisted of 89.4% by weight of dioctyl sebacate and 10.6% by weight of methylethyl ketone peroxide. The weight ratio of oxidizer/first liquid/second liquid was maintained at 37.2:4.4:1 by a continuous weighing and automatic metering system controlled by a computer so that the mixture being formed has the following formulation:

| | |
|---|---|
| Acrylate-terminated polybutadiene (Atochem Poly Bd 300) | 10.23% |
| Methylethyl ketone peroxide | 0.25% |
| Mn Tallate (Mn Lin-All by Mooney) | 0.04% |

-continued

| | |
|---|---|
| Dioctyl sebacate | 2.10% |
| Potassium perchlorate | 87.38% |

Zones 85, 86, and 87 were unheated and zone 88 was maintained at 150° F. as the three components were mixed by the screw 84 in zones 85–87 and formed into a binder/fuel grain having four lobes and a longitudinal perforation extending through each lobe by extrusion through a die assembly comprising the die body 11 and the die insert 60 attached to the extruder in zone 88. Curing of the composition during the 40 second residence time was sufficient to form a grain which retained the die-imposed shape as it traveled onto the conveyor 89 for final curing at 135° F. within the enclosure 90.

Thus, in accordance with the invention, there has been provided a gas generant composition and a method for extruding and shaping it into a grain suitable for use as a binder-fuel in a hybrid system for inflating air bags in passenger vehicles.

While the above description constitutes the preferred embodiment of the present invention, it will be appreciated that the invention is susceptible to modification, variation and change without departing from the proper scope and fair meaning of the accompanying claims.

The subject matter claimed is:

1. A method for forming a gas generant grain for an air bag inflation system, said method comprising mixing an amount of an oxidizer sufficient to convert all available carbon to carbon dioxide and all available hydrogen to water, a curing agent, and at least one thermosetting resin selected from the group consisting of an acrylate terminated polybutadiene, an ester formed by the reaction of a polybutadiene polycarboxylic acid with an epoxy modified polybutadiene, an ester formed by the reaction of a polybutadiene polycarboxylic acid with a hydroxyl-terminated polybutadiene, a styrene/polyester copolymer, and a hydroxy-terminated polybutadiene/diisocyanate reaction product, charging the mixture into an extruder in which a temperature of from about room temperature to about 200° F. is maintained, and pushing the mixture through the extruder.

2. The method of claim 1 wherein the temperature is maintained at from about 100° to about 135° F.

3. The method of claim 2 wherein the residence time of the mixture in the extruder is from about 30 seconds to abvout 5 minutes.

4. The method of claim 1 further comprising pushing the mixture through a die in communication with the extruder, forming a plurality of interconnected longitudinal lobes in the mixture in alignment with the axis of the die, and forming a plurality of longitudinal bores in said lobes in alignment with and arrayed about said axis.

5. The method of claim 4 wherein the resin is an acrylate terminated polybutadiene.

6. The method of claim 4 wherein the resin is a maleic acid modified polybutadiene/epoxy modified polybutadiene reaction product.

7. The method of claim 4 wherein the resin is a styrene/polyester copolymer.

8. The method of claim 4 wherein the resin is a hydroxy-terminated polybutadiene/diisocyanate reaction product.

* * * * *